US005607051A

United States Patent [19]

Espinosa

[11] Patent Number: 5,607,051

[45] Date of Patent: Mar. 4, 1997

[54] CIGAR HUMIDOR

[76] Inventor: Jorge L. Espinosa, 90 B River Vale Ct., Scotch Plains, N.J. 07076

[21] Appl. No.: 618,064

[22] Filed: Mar. 25, 1996

[51] Int. Cl.[6] ..... A24F 25/02

[52] U.S. Cl. ..... 206/213.1; 206/256; 312/31.1

[58] Field of Search ..... 206/204, 205, 206/213.1, 242, 248, 256; 312/31, 31.01–31.06, 31.1–31.3; 131/300

[56] References Cited

U.S. PATENT DOCUMENTS

| | | | |
|---|---|---|---|
| 273,205 | 2/1883 | Wentzell et al. . | |
| 441,557 | 11/1890 | Heydt | 312/31 |
| 510,928 | 12/1893 | Parish | 312/31.2 |
| 693,469 | 2/1902 | Wagner et al. | 312/31.2 |
| 720,111 | 2/1903 | Castillo . | |
| 1,054,159 | 2/1913 | Wilson . | |
| 1,474,264 | 11/1923 | Karp . | |
| 1,668,892 | 5/1928 | Durham | 312/31 |
| 1,676,118 | 7/1928 | Sukert . | |
| 1,712,024 | 5/1929 | Brogden | 312/31 |
| 1,954,577 | 4/1934 | Reddin . | |
| 2,323,820 | 7/1943 | Lilienfield . | |
| 2,474,173 | 6/1949 | Trinko . | |
| 2,506,191 | 5/1950 | Bayuk . | |
| 2,860,023 | 11/1995 | Herdlitchka . | |
| 2,977,171 | 3/1961 | Gleason . | |
| 3,336,093 | 8/1967 | Phelps . | |
| 4,008,930 | 2/1977 | Swainson . | |

*Primary Examiner*—Jimmy G. Foster
*Attorney, Agent, or Firm*—Anthony J. Casella; Gerald E. Hespos

[57] ABSTRACT

A cigar humidor is provided. The humidor includes first and second cigar storage compartments. The first compartment includes a humidifier such that cigars stored in the first compartment communicate with the humidifier and are capable of long-term storage. The second compartment is isolated from all sources of humidity and is substantially smaller than the first compartment. Cigars intended for long-term storage are contained in the first compartment. Cigars intended for smoking in the near term future are moved from the first compartment to the second compartment and are permitted to undergo a controlled dehumidification and to be in optimum condition for smoking shortly after being placed in the isolated second compartment.

14 Claims, 3 Drawing Sheets

CIGAR HUMIDOR

Background of the Invention

1. Field of the invention

The subject invention is directed to a cigar humidor to enable long-term storage of cigars and to enable a small supply of cigars to be maintained for relatively short periods of time in optimum conditions for smoking.

2. Description of the Prior Art

Cigar smoking has been subject to renewed popularity in the 1990's. The focus of this renewed popularity has fairly expensive cigars that are made by hand from carefully selected tobaccos. Cigar-of-the-month clubs exist for distributing select cigars to smokers by mail. Magazines exist for connoisseurs in which various brands of cigars are rated in much the way that vintage wines nave been rated for many years. Cigar connoisseurs profess an ability to detect subtle differences between different brands of cigars and different types of cigars produced by any brand manufacturer. Cigars from one country often are considered to be clearly distinguishable from cigars of another country.

It is well known that cigars stored in the absence of humidity will become dry and hard. The outer wrapper of a dry cigar may crumble, and the dry cigar will not burn in the smooth manner desired by cigar smokers. Even a novice cigar smoker can immediately tell the difference between an old dry cigar and a fresh cigar. Most fine cigar retail facilities store their handmade cigars in rooms where humidity and temperature are carefully controlled. A cigar stored under proper conditions will last for many years, and may improve with age. Most cigar smokers will have one or two types of cigars for smoking on a regular basis. These cigars will be purchased in a sufficient quantity to avoid frequent trips to the smoker's favorite cigar store. Most cigar smokers also may have a small number of finer cigars that are kept on hand for special occasions. It is not uncommon for even an occasional smoker of cigars to maintain a cache of 50–100 cigars.

Cigar smokers are well aware of the need to prevent their cigars from drying out. As a result, most cigar smokers own a tabletop humidor. The typical prior art humidor is a wooden box with a hinged top. Interior portions of the box are dimensioned to protectively surround a supply of cigars. The prior art humidor also includes a source of humidity that delivers moisture to the cigars in the humidor. Some prior art humidors include a reservoir of water adjacent the bottom of the humidor. A perforated wall defines the floor of this prior art humidor upon which the cigars are placed. Thus water vapor in the reservoir will migrate through the perforations to keep the cigars moist.

Other prior art humidors include a moisture retaining pad at an upper location in the humidor, such as in the cover. The heavy moisture-laden air is believed to settle efficiently in the humidor thereby imparting sufficient moisture to the cigars. The moisture retaining material in the cover may be periodically replaced or remoistened to maintain a desirably high level of humidity.

Some prior art humidors include a plurality of separate compartments. However, the separate compartments all communicate with the source or sources of moisture. One such multi-compartment humidor is shown in U.S. Pat. No. 2,506,191. This prior art is constructed to ensure that all compartments are exposed to moisture while preventing the aroma from tobacco products in one compartment from migrating into another compartment in a manner that could achieve contamination of the unique tobacco flavor and aroma in each of the separate compartments.

U.S. Pat. No. 720,111 shows a cigar maker's work box with separate compartments for filler, binder, wrapper and for finished cigars. All compartments communicate with a single reservoir of water.

U.S. Pat. No. 273,205 shows a complex ornate cabinet for storing cigars and pipe tobacco. Cigars are stored on the shelves in an upper portion of the cabinet and the entire are enclosed by the shelves communicates with a single fluid reservoir near the bottom of the cabinet. Pipe tobacco products are stored in separate compartments between the fluid reservoir and the cigar shelves. The pipe tobacco compartments communicate with separate reservoirs which may be filled with appropriate aromatic liquids for imparting a desired taste and aroma to the pipe tobacco stored in the respective compartments.

Humidors, including those shown in the above referenced patents impart a uniform level of humidity to all cigars stored in the humidor. The humidity will ensure that the stored cigars can be maintained for a long period of time. Although humid cigars can be stored for a long time, they are not typically at optimum conditions for smoking. A humid cigar provides better smoking than the above referenced overly dried cigar, but does not provide for the optimum smooth smoke with the best aroma and taste available from a particular cigar. Cigars stored in the best commercially available humidors often will be overly soft and may approach a soggy condition particularly near the ends.

In view of the above, it is an object of the subject invention to provide a humidor that enables long-term storage of cigars but that also enables cigars to be at optimum conditions for smoking.

SUMMARY OF THE INVENTION

The subject invention is directed to a cigar humidor having a first compartment communicating with a supply of humidity and a second compartment isolated from humidity. The first compartment may be considerably larger than the second compartment and is intended to hold cigars for long-term storage. The second and smaller compartment is dimensioned to accommodate a small number of cigars for a shorter period of time. Thus, the second compartment is used to temporarily store cigars that are intended to be smoked within approximately one or two days of being placed therein. The walls of the second compartment preferably are formed from a material that will absorb moisture from cigars placed therein. For example, the walls of the second compartment may be formed from a wood appropriate for these purposes, such as Spanish cedar.

Both the first and second compartments may be constructed to prevent permeation of significant amounts of moisture therethrough. Thus, this construction will ensure that moisture in the first compartment will be substantially retained therein for maintaining the cigars over a long period of time. Additionally, the walls of the second compartment will ensure that cigars placed in the second compartment for a short period of time will not dry out extensively during that short period of time. However, moisture in a cigar placed in the second compartment may be absorbed into the walls of the second compartment, thereby enabling a lowering of the moisture content of the cigar during the time it is stored in the smaller second compartment of the humidor.

First and second compartments may be accessible from separate access means. For example, the first compartment may be accessible from a lid, while the second compartment may be accessible from a drawer or a second lid. Alternatively, both compartments are accessible from a single lid and are separated from one another by a wall extending to a height sufficient for engaging the lid in substantially fluid tight engagement and preventing migration of moisture from the first compartment to the second compartment when the lid is closed. The source of humidity may be mounted to a portion of the single lid disposed in registration with the first compartment. Moisture flow from the first compartment to the second compartment is substantially not a problem when the lid is opened and both compartments are exposed to an ambient atmosphere.

In use, a supply of cigars is placed in the first compartment for long-term storage. Moisture is placed in communication with the first compartment by an appropriate known humidity device. A smaller supply of cigars is then placed in a second compartment. The cigars placed in the second compartment are those that the smoker intends to smoke during the next day or two. The lid is closed thereby placing the cigars in the first compartment in communication with the supply of humidity maintaining those cigars for an extended period of time. The small number of cigars in the second compartment are isolated from humidity, thereby permitting moisture that had been absorbed into the cigars to permeate into surrounding portions of the isolated second compartment and, for example, into the walls of the second compartment. The lid may be opened periodically to remove cigars from the second compartment for smoking. Cigars may periodically be moved from the first compartment to the second compartment and the larger supply of cigars in the first compartment may be periodically replenished. Cigars removed from the second compartment for smoking are considerably drier than those that would have been removed directly from the first compartment or from the humidity compartment of any prior art humidor. However, the cigars in the first compartment are protected from physical damage which could occur if the cigars were merely left in an unprotected area and are further protected from excessive drying which could occur quickly in ambient atmospheric conditions.

DETAILED DESCRIPTION OF THE PREFERRED EMBODIMENT

Figure 1:
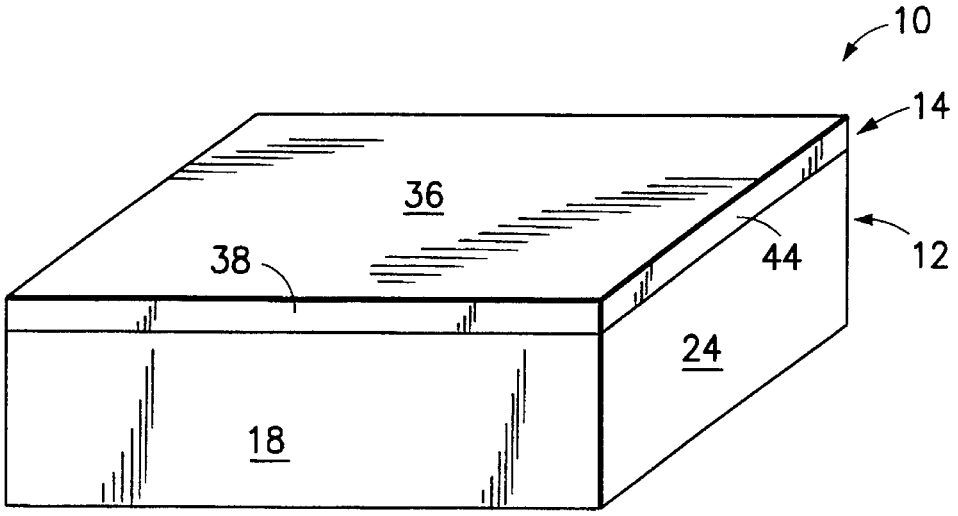
FIG. 1 is a perspective view of a humidor in accordance with the subject invention.
Figure 2:
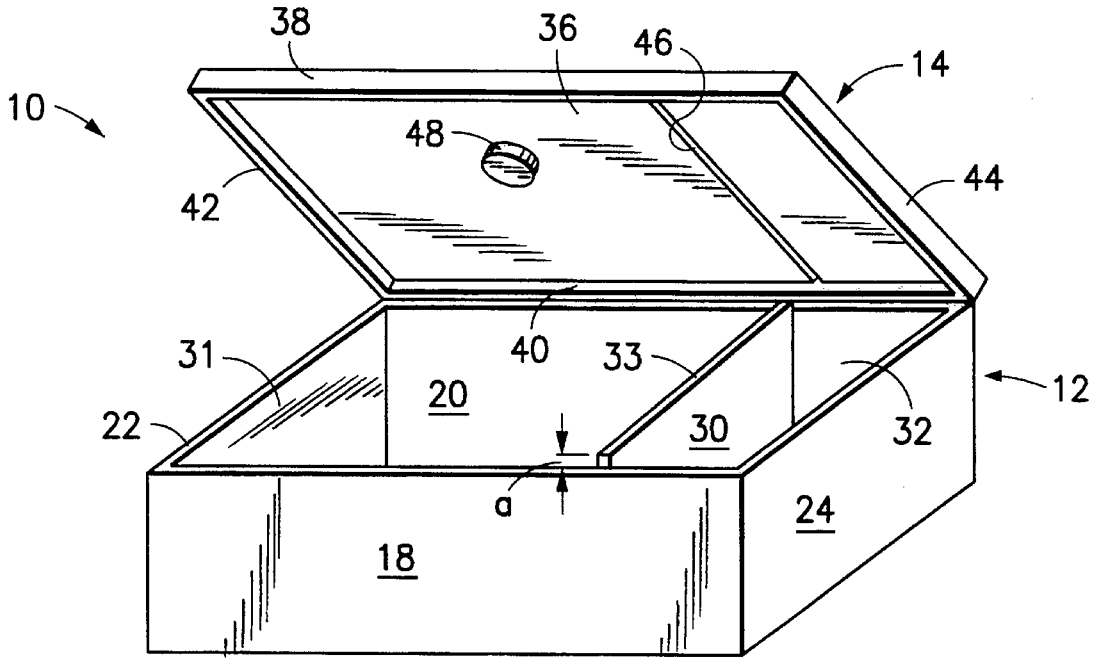
FIG. 2 is a perspective view of the humidor shown in FIG. 1, but depicted in the opened condition.
Figure 3:
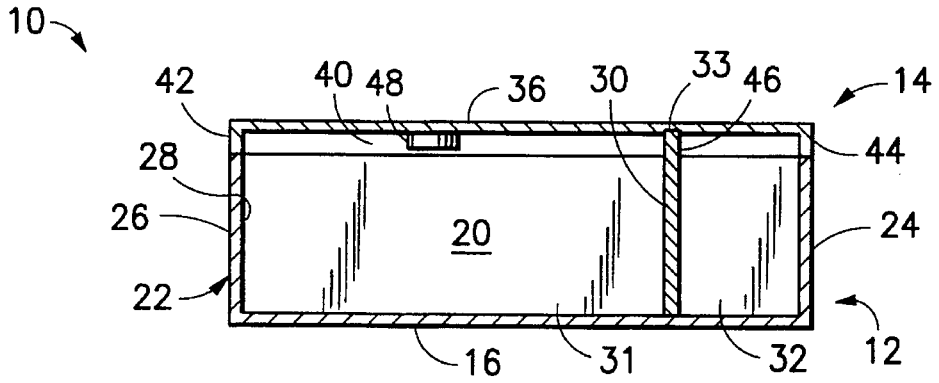
FIG. 3 is a cross-sectional view taken along line 3—3 in FIG. 1.

A cigar humidor in accordance with the subject invention is identified generally by the numeral 10 in FIGS. 1–3. The humidor 10 is a substantially rectangular box-like structure with a base 12 and a lid 14. The base 12 includes a rectangular bottom wall 16, opposed parallel front and rear walls 18 and 20 extending orthogonally upwardly from the bottom wall 16 and opposed parallel rectangular side walls 22 and 24 extending upwardly from the bottom wall 16 and connecting the respective front and rear walls 18 and 20. As depicted herein, the walls 18–24 are of multi-ply construction with each wall having an outer layer 26 formed from a wood or other material selected for its decorative appearance and an inner layer 28 formed from a wood selected for its moisture retention and moisture resistivity characteristics. In particular, the inner layer preferably is formed from an unfinished Spanish cedar, which is known in the art to exhibit desirable characteristics for tobacco humidors. The outer layer 26 may be formed from any desirable wood material, such as cherry or mahogany, and also may be formed from certain non-wood materials selected for their visual appearance. The primary performance requirement of the outer layer 26 is to be substantially impervious to liquids and vapors. The liquid impervious characteristics may be achieved by a coating applied to the outer surface of the outer layer 26.

The base 12 of the humidor 24 further includes an internal partition 30 extending substantially orthogonally from the bottom wall 16, parallel to the side walls 22 and 24 and connecting the front and rear walls 18 and 20. Thus, the partition 30 divides the base 12 into first and second compartments 31 and 32. The partition 30 is formed from, or coated on at least one side with, a material that is substantially impervious to moisture for reasons explained further herein. As shown most clearly in FIGS. 2 and 3, the partition 30 is substantially closer to the side wall 24 than to the side wall 22. In particular, the distance between the partition 30 and the side wall 22 is approximately four times the distance between the partition 30 and the side wall 24. An even greater disparity between these respective dimensions may also be provided. However, the distance between the partition 30 and the side wall 24 must be sufficiently great to enable cigars stored in the second compartment 32 to be conveniently accessed by hand. Thus, a distance of at least approximately two inches must be provided between the partition 30 and the side wall 24.

Figure 4:
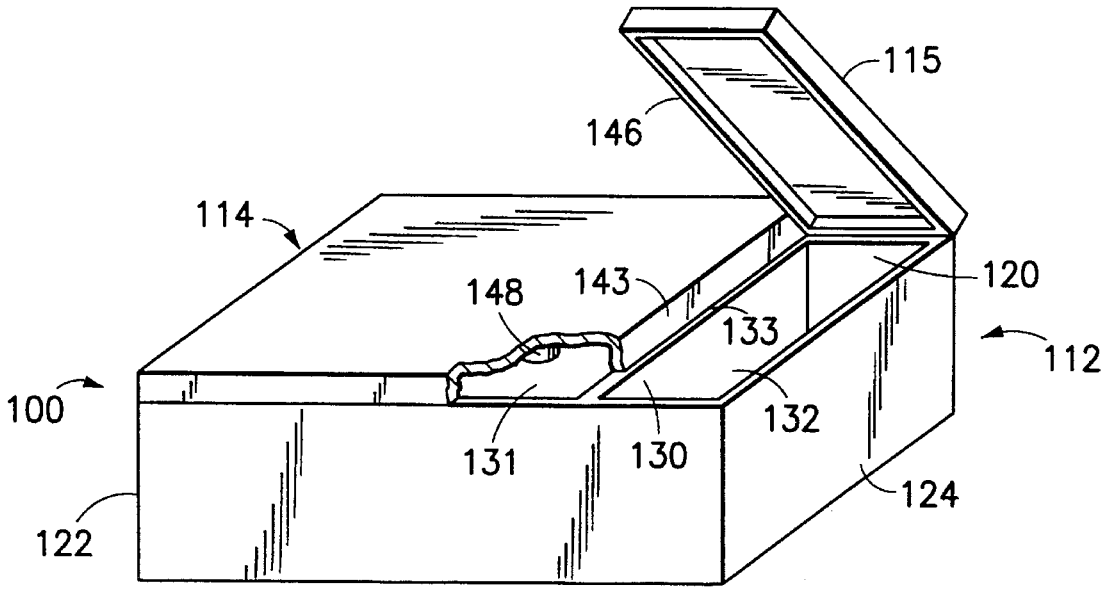
FIG. 4 is a perspective view similar to FIG. 2, but showing a second embodiment of a humidor in accordance with the subject invention.

As shown most clearly in FIGS. 2–4, the front and rear walls 18 and 20 and the side walls 22 and 24 all extend a uniform distance from the bottom wall 16. However, the partition 30 has a top edge 33 disposed a distance "a" above the top edges of the walls 18–24 for reasons explained further herein.

The lid 14 includes a rectangular top wall 36 dimensionally substantially identical to the bottom wall 16. The lid 14 further includes a front wall 38 and a rear wall 40 extending parallel to one another and projecting a short distance orthogonally from the top wall 36. The lid 14 further includes opposed side walls 42 and 44 projecting orthogonally from the top wall 36 and connecting the front and rear walls 38 and 40 of the lid 14. The front and rear walls 38 and 40 and the side walls 42 and 44 of the lid 14 extend substantially equal distances from the top wall 36. Additionally, the front and rear walls 38 and 40 and the side walls 42 and 44 of the lid 14 are disposed to register substantially precisely with corresponding front and rear walls 18 and 20 and the side walls 22 and 24 of the base 12, as depicted most clearly in FIGS. 1 and 3.

The rear wall 40 of the lid 14 is hingedly connected to the rear wall 20 of the base 12. As a result, the lid 14 can be articulated from the closed position shown in FIG. 1 to the opened position shown in FIG. 2. Significantly, the extension of the front and rear walls 38 and 40 and the side walls 42 and 44 of the lid 14 from the top wall 36 thereof may be substantially equal to the difference in height "a" between the partition 30 and the respective walls 18–24 of the base 12. With these relative dimensions, the top edge 33 of the partition 30 will substantially abut against the top wall 36 of the lid 14 when the lid 14 is in the closed position shown in FIGS. 1, 3 and 4. In certain embodiments, the difference "a" between the height of the partition 30 and the walls 18–24 of the base 12 may be even greater than the height of the walls 38–44 of the lid 14. In these embodiments, the inner surface of the top wall 36 is provided with a groove 46 disposed and dimensioned to register with and receive the top edge 33 of the partition 30.

The lid 14 further is provided with a humidifier 48 on the inwardly facing surface of the top wall 36, and disposed to register with a portion of the base 12 between the side wall 22 and the partition 30. The humidifier 48 may be of known construction, and may, for example, include a replaceable or refillable pad into which distilled water may be placed for imparting humidity.

As shown most clearly in FIG. 3, the first and second compartments 31 and 32 of the base 12 are substantially isolated from one another by the partition 30. This isolation is achieved by the close engagement between the upper edge 33 of the partition 30 and the inner surface of the top wall 36 on the lid 14. Also as shown in FIG. 3, the first compartment 31 of the base 12 communicates directly with the humidifier 48, while the second compartment 32 of the base 12 is substantially isolated from the humidifier 48.

In use, the larger first compartment 31 of the base 12 is used for long-term storage of a significant number of cigars. The much smaller second compartment 32 of the base 12 is used for short-term storage of cigars that are likely to be smoked during approximately a twenty four hour period following placement of cigars in the small second compartment 32. Cigars in the large first compartment 31 are in communication with the humidifier 48, and hence retain moisture therefrom and will last for an extended period of time. However, as noted above, cigars in the large first compartment 31 are apt to retain more moisture than desirable and optimal for immediate smoking. Cigars in the smaller second compartment 32 will impart moisture to interior surfaces of the unfinished Spanish cedar defining the second compartment 32. Thus, cigars in the small second compartment 32 will undergo a control dehumidifying process and will be in an optimal condition for smoking shortly after placement therein. Cigars in the small second compartment 32 will maintain their optimal smoking characteristics for at least 24–48 hours of being placed therein without being in immediate danger of excessive drying. Thus, a typical cigar smoker will move a day's supply of cigars from the large first compartment 31 to the small second compartment 32 for smoking over a one or two day period following placement of the cigars herein.

An alternate cigar humidor is depicted more clearly in FIG. 4 and is identified generally by the numeral 100. The humidor 100 includes a base 112 substantially identical to the base 12 described above and illustrated in FIGS. 1–4. However, in this embodiment, the partition 130 extends to approximately the same height as the walls 118-124. The humidor 100 differs from the humidor 10 in that it includes separate first and second lids 114 and 115 respectively. The first lid 114 is articulated to the rear wall 120 and a portion of the rear wall 120 between the side wall 122 and the partition 130. The first lid 115 is provided with a side wall 143 that will engage the top edge 133 of the partition 130 to effectively seal the first compartment 131. A humidifier 148, substantially as described above, is disposed on portions of the lid 114, and hence will impart humidity to the first compartment 131 substantially as described above.

The second lid 115 is articulated to portions of the rear wall 120 between the side wall 124 and the partition 130. The second lid 115 includes a wall 146 that will substantially abut the wall 143 of the first lid 114 and that will sealingly engage the top edge 133 of the partition 130 to sealingly enclose the second compartment 131. As in the previous embodiment, the second compartment 131 is substantially enclosed from ambient atmospheric conditions but also is isolated from the first compartment 131, and the humidifier 148 therein. The isolation of the second compartment 131 from any source of humidity permits a controlled dehumidifying of cigars placed therein. Thus, the humidor 100 is used in substantially the same manner as the humidor 10 described above. However, the humidor 100 provides an additional advantage in that the cigar smoker need not open the humidity controlled first compartment 131 each time a cigar is being removed from the smaller isolated second compartment 132. Thus, the larger supply of cigars can be maintained carefully in their humidity controlled environment, while cigars intended for a day's smoking are isolated from the supply of humidity and are permitted to undergo a controlled dehumidification.

Figure 5:
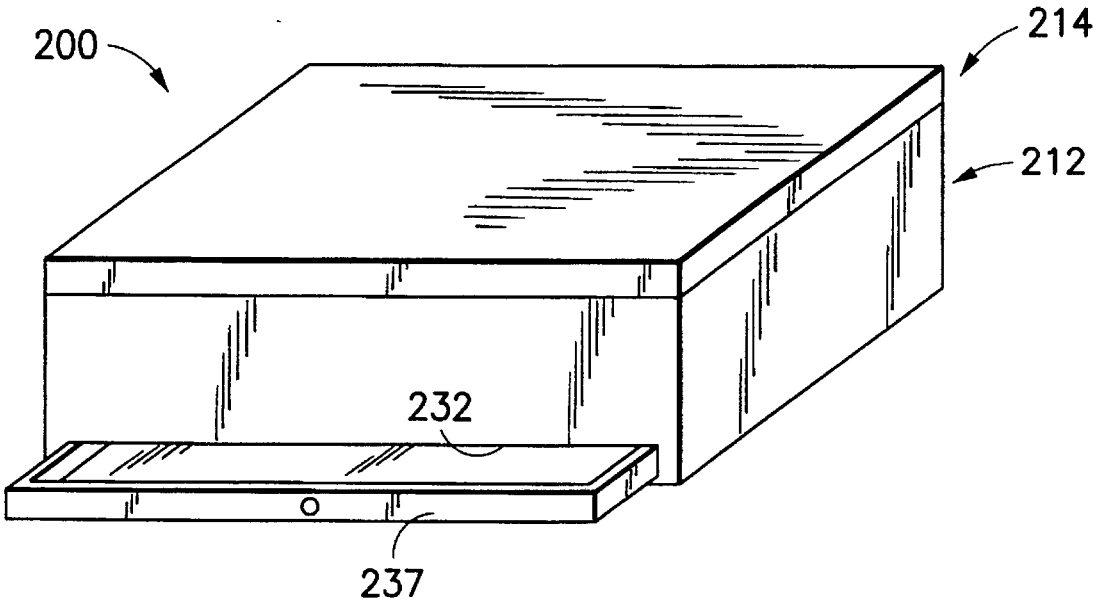
FIG. 5 is a perspective view similar to FIG. 2, but showing a third embodiment of the humidor.

A third embodiment of the humidor of the subject invention is identified generally by the numeral 200 in FIG. 5. The humidor 200 in FIG. 6 includes a base 212 and a lid 214. The base 212 differs from the base described in the previous embodiments in that it does not include a partition therein. The lid 214 includes a humidifier that communicates with the entire compartment defined by the walls of the base 212.

The base 212 further is provided with a separate isolated compartment 232 extending into the front wall 218. The humidor 200 further includes a drawer 237 extending into the isolated second compartment 232. This embodiment functions and is used in substantially the same way as the previous embodiments. Cigars intended for long-term storage are placed in the first compartment and communicate with the humidifier. Cigars intended for a day's smoking are removed from the first compartment and are placed in the isolated second compartment 232 defined by the drawer 237. Cigars in the second compartment 232 are permitted to undergo a control dehumidification and can be accessed sequentially for smoking without interfering with the humidity controlled environment in the first compartment.

While the invention has been described with respect to certain preferred embodiments, it is apparent that various changes can be made without departing from the scope of the invention as defined by the appended claims.

I claim:

1. A cigar humidor comprising a base having a bottom wall and a plurality of upstanding side walls connected to and extending from said bottom wall for defining an open-topped enclosure, a substantially moisture impervious partition extending between and connecting a pair of said side walls of the said base for dividing said open-topped enclosure into a first compartment and a second compartment, at least one lid for selectively opening and closing said first and second compartments and for isolating said first and second compartments from ambient environmental conditions, a humidifier being disposed in said first compartment for imparting controlled humidity to cigars stored therein, said partition and said at least one lid isolating said second compartment from said humidifier in said first compartment, whereby said first compartment is employed for long-term storage of cigars, and wherein said second compartment enables controlled dehumidification of cigars intended for short term smoking.

2. The cigar humidor of claim 1, wherein said at least one lid comprises a single lid hingedly connected to one said wall of said base and dimensioned to enclose both said first and second compartments, said partition and said lid being dimensioned for sealingly engaging one another when said lid is closed for isolating said second compartment from said first compartment and from said humidifier.

3. The cigar humidor of claim 2, wherein said partition extends from said bottom wall of said base a sufficient distance to engage said lid.

4. The cigar humidor of claim 3, wherein the lid includes a groove for receiving a portion of said partition for isolating said second compartment from said first compartment and from said humidifier.

5. The cigar humidor of claim 1, wherein said at least one lid includes first and second lids for enclosing the respective first and second compartments defined by said base.

6. The cigar humidor of claim 5, wherein said second compartment is substantially smaller than said first compartment.

7. The cigar humidor of claim 6 wherein said first compartment is at least four times larger than said second compartment.

8. The cigar humidor of claim 5 wherein said first and second lids each are hingedly connected to one said side wall of said base.

9. The cigar humidor of claim 8 wherein portions of said first and second lids are engageable with said partition.

10. The cigar humidor of claim 1, wherein said second compartment is substantially smaller than said first compartment.

11. The cigar humidor of claim 1 comprising an inner layer formed from Spanish cedar.

12. A cigar humidor having first and second accessible compartments isolated from ambient environmental conditions, a humidifier in the first compartment for imparting controlled humidity to cigars stored therein, said second compartment including walls for isolating said second compartment from said humidifier in said first compartment, said second compartment comprising a drawer isolated from said first compartment for selectively storing cigars therein, whereby said first compartment is employed for a long-term storage of cigars, and wherein said second compartment enables controlled dehumidification of cigars intended for short term smoking.

13. A method for storing cigars prior to smoking, said method comprising the steps of:

providing an enclosure with first and second compartments, at least said second compartment being lined with an unfinished wood;

placing said first compartment in communication with a source of humidity such that said second compartment is substantially isolated from said source of humidity;

placing a plurality of cigars in said first compartment and in communication with said source of humidity for long term storage; and periodically moving at least one cigar from said first compartment to said second compartment such that moisture in said cigar in said second compartment permeates into the unfinished wood lining the second compartment.

14. The method of claim 13, wherein the step of moving at least one cigar from said first compartment to said second compartment comprises moving a plurality of cigars from said first compartment to said second compartment, said plurality being substantially equal in number to the cigars intended to be smoked during an approximately twenty-four hour period after being placed in said second compartment.

* * * * *